US006367790B2

(12) United States Patent
Ocklenburg et al.

(10) Patent No.: US 6,367,790 B2
(45) Date of Patent: Apr. 9, 2002

(54) SLIDE-TYPE L-CLAMP

(75) Inventors: Matthias Ocklenburg; Ansgar Honkomp, both of Wuppertal (DE)

(73) Assignee: Richa Werkzeuge GmbH & Co. KG, Remscheid (DE)

( * ) Notice: Subject to any disclaimer, the term of this patent is extended or adjusted under 35 U.S.C. 154(b) by 0 days.

(21) Appl. No.: 09/773,428

(22) Filed: Feb. 1, 2001

(30) Foreign Application Priority Data

Feb. 8, 2000 (DE) ..... 100 05 350

(51) Int. Cl.[7] ..... B25B 1/02

(52) U.S. Cl. ..... 269/166; 269/171.5; 269/254 R; 269/249; 269/258; 269/122

(58) Field of Search ..... 269/166, 171.5, 269/254 R, 249, 258, 224, 167.171; 403/138, 144

(56) References Cited

U.S. PATENT DOCUMENTS 4,336,927 A 6/1982 Goff
6,113,089 A * 9/2000 Kleinbongartz ..... 269/166

FOREIGN PATENT DOCUMENTS

DE 42 36 049 4/1994
DE 197 48 130 5/1999

* cited by examiner

*Primary Examiner*—Joseph J. Hail, III
*Assistant Examiner*—Daniel Shanley
(74) *Attorney, Agent, or Firm*—Herbert Dubno; Andrew Wilford

(57) ABSTRACT

A bar clamp has a straight and stiff metal bar having an straight inner face, a straight and stiff fixed metal arm extending from an end of the bar and having a straight inner face substantially perpendicular to the bar inner face, and a metal corner unitarily formed with the bar and arm and joining the bar to the arm. A longitudinally facing abutment pad is carried on an outer end of the fixed arm. The corner has a circularly arcuate inner face joining the bar and arm inner faces, offset outward from planes lying on the bar and arm inner faces, and having a center of curvature substantially at a point where the planes meet. A movable arm can slide longitudinally along the bar and carries a tightening mechanism in turn carrying an abutment confronting the fixed-arm abutment and longitudinally displaceable relative to the movable arm toward and away from the fixed-arm abutment.

6 Claims, 3 Drawing Sheets

SLIDE-TYPE L-CLAMP

FIELD OF THE INVENTION

The present invention relates to a clamp. More particularly this invention concerns a slide- or jam-type L- or bar clamp.

BACKGROUND OF THE INVENTION

A standard L- or bar clamp has a straight bar along which can slide a movable arm or jaw whose outer end is traversed by a threaded spindle having on one end a crank or handle and on the opposite end an abutment pad. One end of the bar is formed or provided with a transverse fixed arm or jaw whose outer end is also provided with an abutment pad aligned in a longitudinal direction parallel to the bar with the pad of the spindle. The movable jaw can be slid along the bar and jammed tight in any of a multiplicity of longitudinally offset positions for a coarse setting of the abutment-pad spacing. Thus for use the objects being clamped are positioned between the pads, then the movable jaw is slid in until the movable pad presses the objects against the fixed pad, and finally the spindle is cranked to force the movable pad against the objects.

As described in German patent document 4,236,049 of Mayer, the fixed arm is unitarily formed with the bar. To this end the bar is simply C-shaped at one end to form the fixed arm. Such an arrangement is not sufficiently strong.

In German patent document 197 48 130 of Kopf the bar is basically L-shaped with the short leg forming the fixed arm and the long leg the slide bar. Such a system is also not capable of withstanding the considerable forces that often need to be applied.

U.S. Pat. No. 4,336,927 of Goff describes a spring-type clip where a movable part slides along a round-section rod having a bend-out corner. This system has no screw-type clamping system, and is purely intended for light-duty clamping operations.

OBJECTS OF THE INVENTION

It is therefore an object of the present invention to provide an improved heavy-duty jam-type clamp.

Another object is the provision of such an improved heavy-duty jam-type clamp which overcomes the above-given disadvantages, that is which is quite strong and that still can be tightened by standard screw action.

SUMMARY OF THE INVENTION

A bar clamp has according to the invention a straight and stiff metal bar having an straight inner face, a straight and stiff fixed metal arm extending from an end of the bar and having a straight inner face substantially perpendicular to the bar inner face, and a metal corner unitarily formed with the bar and arm and joining the bar to the arm. A longitudinally facing abutment pad is carried on an outer end of the fixed arm. The corner has an arcuate inner face joining the bar and arm inner faces, offset outward from planes lying on the bar and arm inner faces, and symmetrical to a bisector extending through a point where the planes meet. A movable arm can slide longitudinally along the bar and carries a tightening mechanism in turn carrying an abutment confronting the fixed-arm abutment and longitudinally displaceable relative to the movable arm toward and away from the fixed-arm abutment.

With this type of corner construction the clamp has considerable strength due to the arcuate shape of the corner.

At the same time it can be cozied up very close to a workpiece, for instance a counter top, from whose corner something projects, as this projection can be accommodated by the outwardly offset clamp corner. The rounded shape is very strong and any elastic deformation of the clamp will be in a direction preventing the clamp from slipping off the objects held between its abutments.

According to another feature of the invention the corner has a circularly arcuate inner face joining the bar and arm inner faces, offset outward from planes lying on the bar and arm inner faces, and having a center of curvature substantially at the point where the planes meet.

The corner inner face in accordance with the invention extends relative to the center over about 270°. Furthermore the bar, corner, and fixed arm are of continuous unchanging cross-sectional shape and have a predetermined width. The radius of curvature of the corner inner face is equal to between 50% and 100% of the bar width.

The tightening mechanism according to the invention includes a spindle threaded into the outer end of the movable arm and having one end carrying the movable-arm abutment an opposite end carrying a handle.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
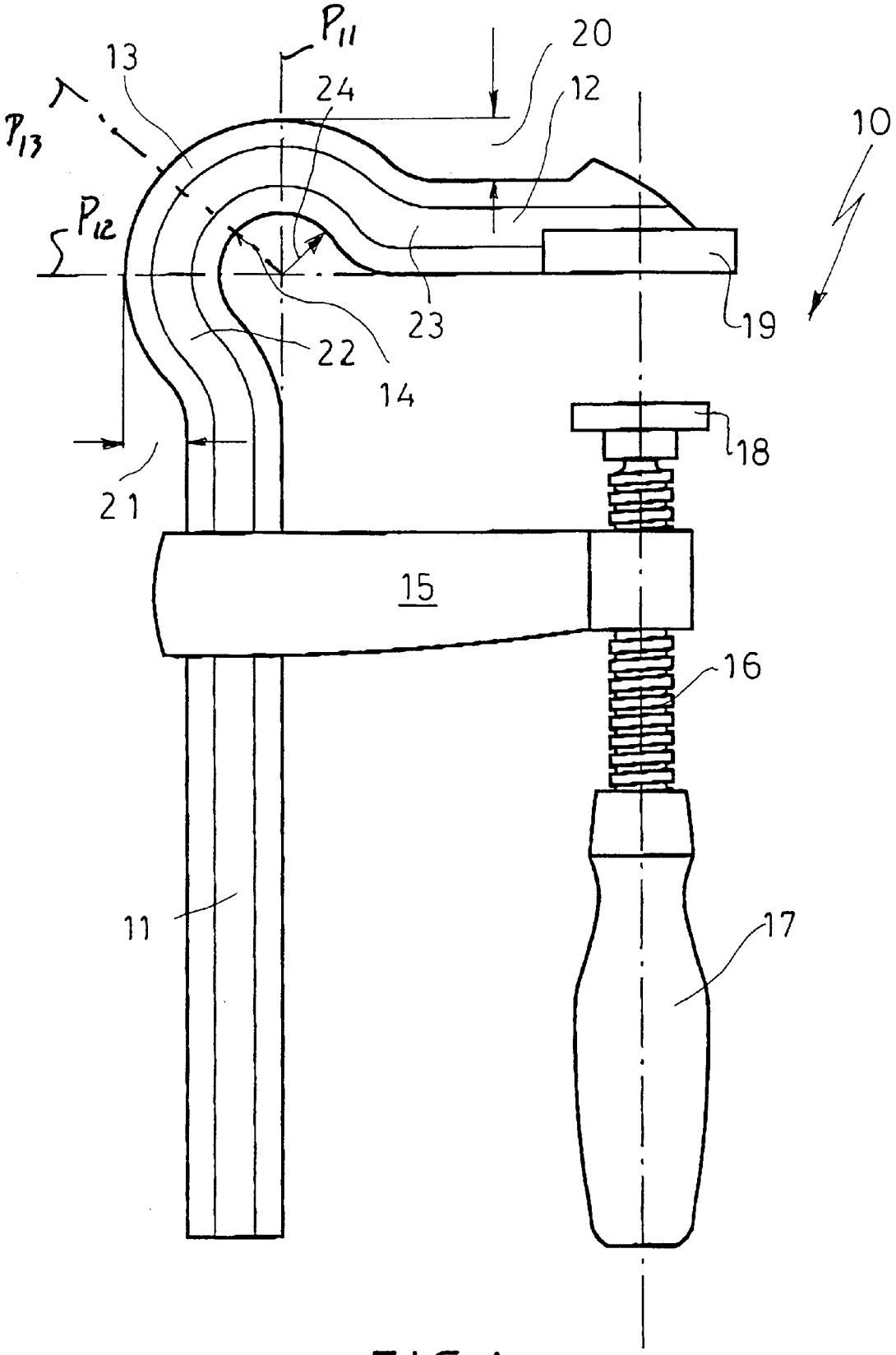
FIG. 1 is a side view of the clamp according to the invention.
Figure 2:
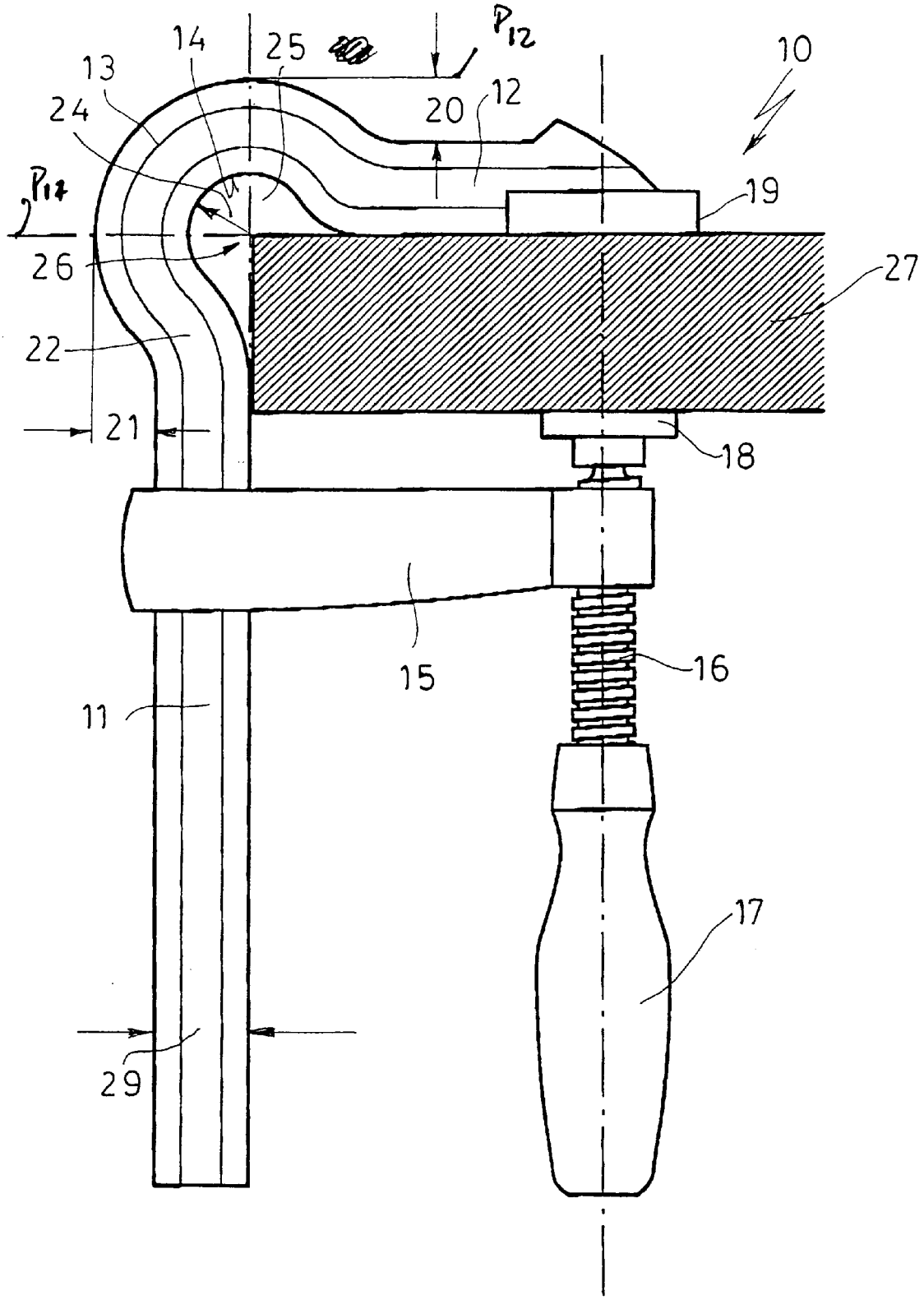
FIG. 2 is a view like FIG. 1 with a workpiece secured in the clamp.
Figure 3:
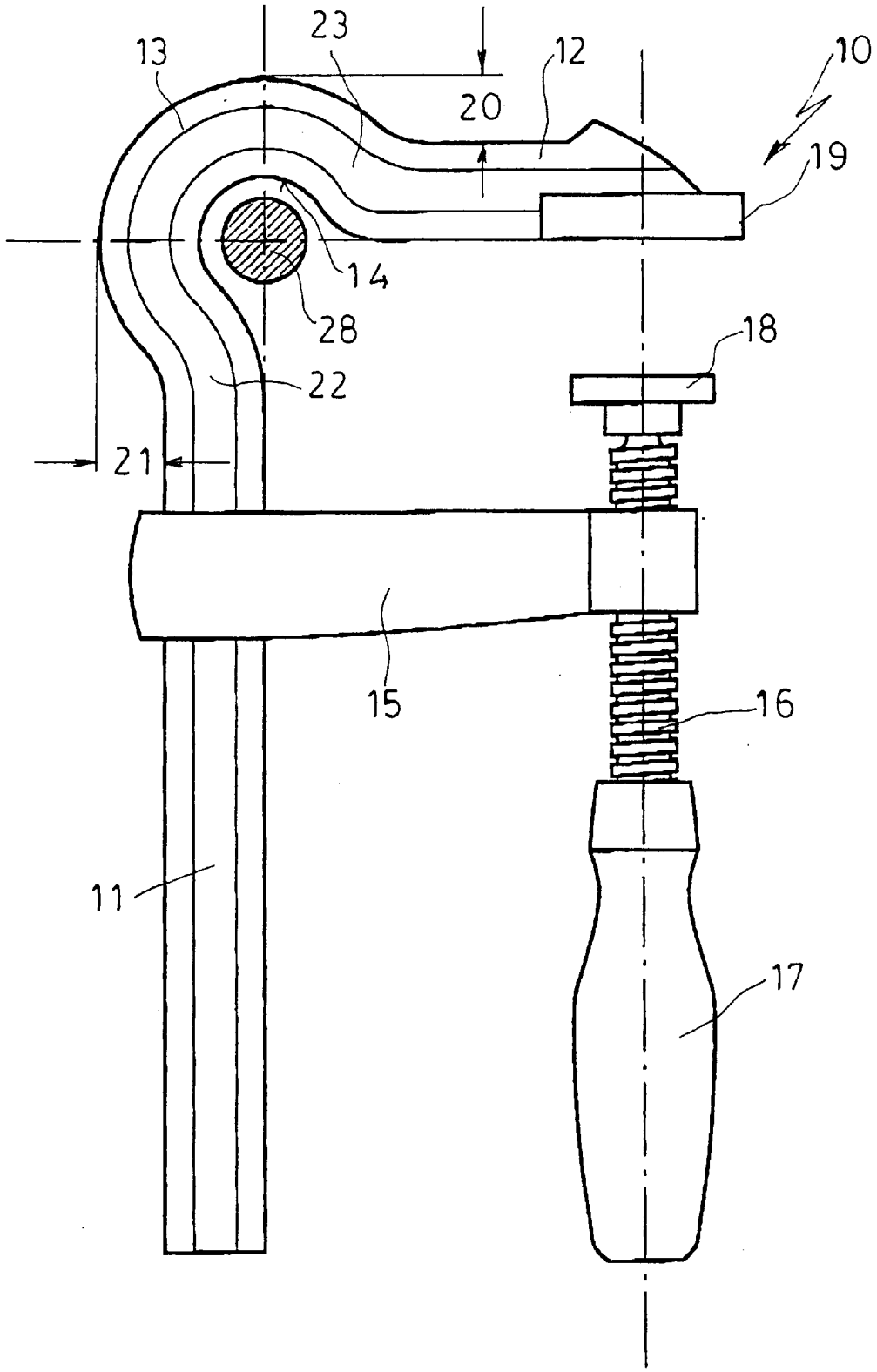
FIG. 3 is another side view showing the clamp suspended from a rod.

As seen in FIGS. 1 through 3 a clamp 10 according to the invention has a bar 11 formed unitarily with a fixed arm 12 to which it is joined at a corner or elbow 13 having an inner surface 14. The bar 11, arm 12, and elbow 13 are of constant profiled cross section and are made of a single bent piece of cold-rolled steel so as to be very strong. The bar 11 has an inner face lying on a plane $P_{11}$ and the arm 12 has an inner face lying on a plane $P_{12}$ extending perpendicular to the plane $P_{11}$ and meeting same at a point 26 which is the center of curvature of the inner surface 14 which extends over about 270° relative to the center point 26. A bisector plane $P_{13}$ to which the corner 13 is symmetrical also extends through this point 26. Thus the elbow 13 projects by distances 20 and 21 past back faces of the arm 12 and bar 11 and is joined to them in regions 22 and 23. The elbow surface 14 has a radius of curvature 24 equal to about 75% of a thickness 29 (FIG. 2) of the bar 11.

A movable arm 15 can slide and jam tight in any longitudinal position along the bar 11 and has an outer end into which is threaded a spindle 16 carrying a handle or crank 17 at one end and an abutment pad 18 at the opposite end. The fixed arm 12 carries at its outer end an abutment pad 19 longitudinally confronting the pad 18. The inner face of this pad 19 is co-planar with the inner workpiece face on the plane $P_{12}$ so that when the clamp is applied to a workpiece 27 as shown in FIG. 2 the entire inner face of the arm 12 can lie on the workpiece 27.

With this arrangement the offset corner 13 forms a space 25 that can easily accommodate a corner of a workpiece 27, even if this corner has something projecting off it like a piece of untrimmed laminate. Furthermore as shown in FIG. 3 the corner space 25 is perfect for hanging the clamp 10 up on a support rod 28.

We claim:

1. A bar clamp comprising:

a straight and stiff metal bar having a straight inner face;

a straight and stiff fixed metal arm extending from an end of the bar, formed unitarily with the bar, and having a straight inner face substantially perpendicular to the bar inner face;

a longitudinally facing abutment on an outer end of the fixed arm;

a metal corner unitarily formed with the bar and arm and joining the bar to the arm, the corner having an arcuate inner face joining the bar and arm inner faces, offset outward from planes lying on the bar and arm inner faces, symmetrical to a bisector extending through a point where the planes meet, and having a center of curvature substantially at the point where the planes meet;

a movable arm slidable longitudinally along a full length of the bar; and a tightening mechanism carried on an outer end of the movable arm and carrying an abutment confronting the fixed-arm abutment and longitudinally displaceable by the mechanism relative to the movable arm toward and away from the fixed-arm abutment.

2. The bar clamp defined in claim 1 wherein the corner inner face extends relative to the center over about 270°.

3. The bar clamp defined in claim 1 wherein the bar, corner and fixed arm are of continuous unchanging cross-sectional shape and have a predetermined width.

4. The bar clamp defined in claim 3 wherein the radius of curvature is equal to between 50% and 100% of the width.

5. The bar clamp defined in claim 1 wherein the mechanism includes a spindle threaded into the outer end of the movable arm and having one end carrying the movable-arm abutment an opposite end carrying a handle.

6. The bar clamp defined in claim 1 wherein the fixed-arm abutment has a face coplanar with the fixed-arm face.

* * * * *